US010967216B2

(12) United States Patent
Seitzer

(10) Patent No.: US 10,967,216 B2
(45) Date of Patent: Apr. 6, 2021

(54) JOINT PROTECTIVE AND MILDLY KINETIC BARBELL

(71) Applicant: BANDBELL LLC, Columbus, OH (US)

(72) Inventor: James Seitzer, Columbus, OH (US)

(73) Assignee: BANDBELL LLC, Columbus, OH (US)

( * ) Notice: Subject to any disclaimer, the term of this patent is extended or adjusted under 35 U.S.C. 154(b) by 40 days.

(21) Appl. No.: 16/326,313

(22) PCT Filed: Aug. 18, 2017

(86) PCT No.: PCT/US2017/047506

§ 371 (c)(1),
(2) Date: Feb. 18, 2019

(87) PCT Pub. No.: WO2018/035409

PCT Pub. Date: Feb. 22, 2018

(65) Prior Publication Data

US 2019/0184223 A1 Jun. 20, 2019

Related U.S. Application Data

(60) Provisional application No. 62/377,225, filed on Aug. 19, 2016.

(51) Int. Cl.
*A63B 21/072* (2006.01)
*A63B 21/075* (2006.01)

(52) U.S. Cl.
CPC ..... *A63B 21/0724* (2013.01); *A63B 21/075* (2013.01); *A63B 21/0728* (2013.01); *A63B 2209/00* (2013.01); *A63B 2209/02* (2013.01)

(58) Field of Classification Search
CPC ..... A63B 21/0724; A63B 21/0728; A63B 21/075; A63B 21/06; A63B 21/072; A63B 21/078; A63B 21/1496; A63B 21/4049; A63B 2209/00; A63B 2209/02; A63B 2210/50; A63B 21/004; A63B 21/00043; A63B 21/00; A63B 21/00189; A63B 21/026; A63B 21/0722; A63B 21/0726; A63B 21/0783; A63B 21/4033;
(Continued)

(56) References Cited

U.S. PATENT DOCUMENTS 2,447,218 A * 8/1948 Trzesniewski ..... A63B 21/0724 482/106
2,470,815 A * 5/1949 Harvey ..... A63B 21/0728 482/106

(Continued)

*Primary Examiner* — Andrew S Lo
*Assistant Examiner* — Thao N Do
(74) *Attorney, Agent, or Firm* — Tyler S. Dunham

(57) ABSTRACT

The exemplary embodiments herein provide a mildly kinetic barbell having a flexible tube with a hollow center, a first end, and an opposing second end. The barbell preferably has a stiffening element within the hollow center, a first plate stopper attached to the flexible tube near the first end, and a second plate stopper attached to the flexible tube near the second end. The barbell may also have a first loading sleeve at the first end with a second loading sleeve at the second end. Some embodiments also include rack bumpers placed adjacent to the plate stoppers and/or a knurl positioned on a central portion of the flexible tube.

19 Claims, 5 Drawing Sheets

(58) Field of Classification Search
CPC ..... A63B 21/4035; A63B 21/4039; A63B 21/4001; A63B 23/12; A63B 23/00; A63B 23/1218; A63B 23/1209; A63B 23/1236; A63B 23/1227
USPC ..... 482/106, 108
See application file for complete search history.

(56) References Cited

U.S. PATENT DOCUMENTS 3,507,495 A * 4/1970 Fracalossi ..... A63B 59/20 473/513
3,806,121 A * 4/1974 Crossley ..... A63B 23/14 273/335
3,848,480 A * 11/1974 Oseroff ..... B62K 21/12 74/558.5
4,252,316 A * 2/1981 Price ..... A63B 21/0728 482/106
4,369,968 A * 1/1983 Price ..... A63B 21/0601 482/106
4,867,444 A * 9/1989 Castillo ..... A63B 21/0724 482/106
5,152,731 A * 10/1992 Troutman ..... A63B 21/0724 482/106
5,300,002 A * 4/1994 Freye ..... A63B 23/12 482/114
5,311,967 A * 5/1994 Kennedy ..... A63B 27/00 182/133
5,393,284 A * 2/1995 Wesley ..... A63B 21/0602 482/106
5,536,227 A * 7/1996 Polchek ..... A63B 21/0728 482/106
5,591,109 A * 1/1997 Strnad ..... A63B 21/0728 24/524
5,603,680 A * 2/1997 Larsen ..... A63B 21/0728 24/523
5,839,996 A * 11/1998 Gooding ..... A63B 21/072 482/106
5,842,957 A * 12/1998 Wheeler ..... A63B 21/0602 482/111
6,770,016 B1 * 8/2004 Anderson ..... A63B 21/0724 482/106
7,503,881 B2 * 3/2009 Quick ..... A63B 21/0609 482/102
7,727,129 B1 * 6/2010 Goddard ..... A63B 21/0626 482/104
7,815,555 B2 * 10/2010 Webber ..... A63B 21/0618 482/104
8,617,036 B2 * 12/2013 Chen ..... A63B 21/0728 482/107
10,532,241 B2 * 1/2020 Boatner ..... A63B 21/0724
2005/0101453 A1 * 5/2005 Jeneve ..... A63B 21/015 482/106
2006/0252615 A1 * 11/2006 Melcer ..... A63B 23/0405 482/139
2007/0197352 A1 * 8/2007 Charniga ..... A63B 21/06 482/93
2008/0261788 A1 * 10/2008 Blount ..... A63B 21/4019 482/139
2012/0322630 A1 * 12/2012 Hood ..... A63B 22/20 482/106
2014/0018213 A1 * 1/2014 Chen ..... A63B 21/0783 482/106
2014/0045660 A1 * 2/2014 Murray ..... A63B 21/008 482/106
2014/0121075 A1 * 5/2014 Brown ..... A63B 21/026 482/106
2014/0249002 A1 * 9/2014 Fischer ..... A63B 21/0602 482/106
2014/0274595 A1 * 9/2014 Patti ..... A63B 21/4049 482/106
2015/0038302 A1 * 2/2015 O'Brien ..... A63B 21/0724 482/107
2016/0243424 A1 * 8/2016 Vilhelmsen ..... A63B 69/3608
2018/0272176 A1 * 9/2018 Aasa ..... A63B 21/0628
2019/0091508 A1 * 3/2019 Casanova ..... A63B 24/0062
2019/0217147 A1 * 7/2019 Garcia ..... A63B 1/00
2019/0269960 A1 * 9/2019 Barrow ..... A63B 21/4039

* cited by examiner

*Fig. 6*

EMBODIMENT #1

| ELEMENT | LENGTH (IN) | ID (IN) | OD (IN) |
|---|---|---|---|
| CYLINDER 100 | 82 | 1.25 | 1.5 |
| STIFFENING ELEMENTS (2) 600 | 20 | N/A | 1.25 |
| OUTER SLEEVE 400 | 14 | 1.5 | 1.9375 |
| PLATE STOPPER 300 | 1.25 | 1.5 | 3 |
| RACK BUMPER 200 | 6 | 1.5 | 1.9375 |

EMBODIMENT #2

| ELEMENT | LENGTH (IN) | ID (IN) | OD (IN) |
|---|---|---|---|
| CYLINDER 100 | 82 | 1.25 | 1.5 |
| STIFFENING ELEMENT (2) 600 | 82 | N/A | 1.25 |
| OUTER SLEEVE 400 | 14 | 1.5 | 1.9375 |
| PLATE STOPPER 300 | 1.25 | 1.5 | 3 |
| RACK BUMPER 200 | 6 | 1.5 | 1.9375 |

EMBODIMENT #3

| ELEMENT | LENGTH (IN) | ID (IN) | OD (IN) |
|---|---|---|---|
| CYLINDER 100 | 86 | 1 | 1.5 |
| STIFFENING ELEMENTS (2) 600 | 20 | N/A | 1 |
| OUTER SLEEVE 400 | 15 | 1.5 | 1.9375 |
| PLATE STOPPER 300 | 1.25 | 1.5 | 3 |
| RACK BUMPER 200 | 6 | 1.5 | 1.9375 |

EMBODIMENT #4

| ELEMENT | LENGTH (IN) | ID (IN) | OD (IN) |
|---|---|---|---|
| CYLINDER 100 | 86 | 1 | 1.5 |
| STIFFENING ELEMENTS (2) 600 | 20 | N/A | 1 |
| OUTER SLEEVE 400 | 15 | 1.5 | 1.9375 |
| PLATE STOPPER 300 | N/A | N/A | N/A |
| RACK BUMPER 200 | N/A | N/A | N/A |

EMBODIMENT #5

| ELEMENT | LENGTH (IN) | ID (IN) | OD (IN) |
|---|---|---|---|
| CYLINDER 100 | 86 | 1 | 1.5 |
| STIFFENING ELEMENTS (1) 600 | 86 | N/A | 1 |
| OUTER SLEEVE 400 | 15 | 1.5 | 1.9375 |
| PLATE STOPPER 300 | N/A | N/A | N/A |
| RACK BUMPER 200 | 6 | 1.5 | 1.9375 |

JOINT PROTECTIVE AND MILDLY KINETIC BARBELL

CROSS-REFERENCE TO RELATED APPLICATIONS

This application claims priority to and is a National Stage Filing from PCT Application PCT/US2017/047506 filed on Aug. 18, 2017, which claims priority to U.S. Provisional Application No. 62/377,225 filed on Aug. 19, 2016, both of which are herein incorporated by reference in their entirety.

TECHNICAL FIELD

Embodiments generally relate to barbells used in weightlifting exercises.

BACKGROUND OF THE ART

Weightlifting is widely recognized as an important component to a well-rounded exercise routine, specifically for its ability to increase muscle strength, blood flow, and joint stability. However, it has been discovered that for many users, standard weightlifting with traditional steel (or otherwise metallic) barbells can cause increased stress on critical joints such as shoulders, knees, lower back, hips, and elbows. For users already suffering from a reduced joint function or pain/inflammation in a joint, weightlifting with a traditional barbell can cause more harm to these joints, such that the harm to these joints will outweigh any potential benefit from weightlifting.

SUMMARY OF THE EXEMPLARY EMBODIMENTS

Exemplary embodiments provide a new type of barbell for weightlifting, that features a dynamic and mildly-kinetic layered assembly having both strength and stability for supporting heavy plates of traditional weight while also providing a mild instability through mild flexion and oscillation of the device. It has been discovered, that this balance between strength and instability can produce a barbell that will withstand the rigors of use in a weight-training facility while also providing enough flexion to remove large stresses and strains from the joints of users. While a traditional steel barbell increases load levels through a "stable load" method of training, the exemplary mildly-kinetic barbells herein provide an adaptable or "unstable load" platform. The mild, unstable movement of the weight eliminates the harsh, torqueing forces to the shoulder, lower back, and hip joints by activating the joint stabilizers to optimize joint mechanics, balance, and function.

When observing an exemplary device during use, it is only possible to observe a slight difference in movement and flexion between a traditional steel barbell and the mildly kinetic barbell embodiments herein, however it has been discovered that the user will notice an immense difference between the two devices. This subtlety of the mildly kinetic barbell device was surprising to the inventor and the users, and the resulting impact to the joints of the user was much less than what was expected. All of these results were also achieved with a device that was still able to maintain enough stability to perform traditional weightlifting movements (bench press, clean and jerk, squat, etc.) even under very heavy loads using traditional Olympic-style plates of weight, with embodiments able to handle multiple 45 pound plates on each side of the device.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which:

FIG. 6 is a chart showing some example dimensions for various embodiments of the mildly kinetic barbell.

DETAILED DESCRIPTION

Figure 1:
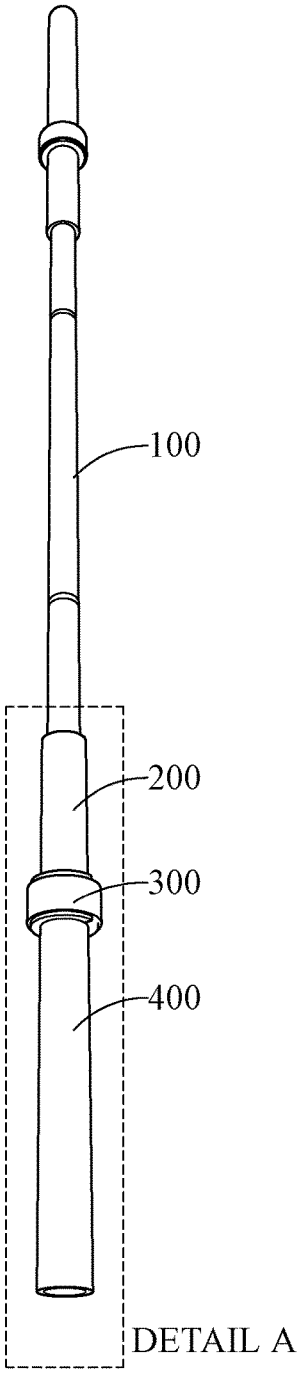
FIG. 1 is a top perspective view of an exemplary embodiment of the mildly kinetic barbell and indicating the location for Detail A.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a top perspective view of an exemplary embodiment of the mildly kinetic barbell and indicating the location for Detail A. A flexible tube 100 preferably travels the entire length of the mildly kinetic barbell, and should have a hollow center. In an exemplary embodiment, the flexible tube 100 would be comprised of a flexible material such as fiberglass or other composite type of material, although this is not required. Preferably, the flexible tube 100 has a bending strength between 25,000 and 35,000 psi. (this should be the approximate bending strength of both the tube 100 on its own as well as the bending strength of the fully assembled barbell when using an embodiment like FIG. 3, which does not have a stiffening element 600 running the entire length of the tube 100, and further does not contain a knurl 150 or stiffening tube 175).

Figure 2:
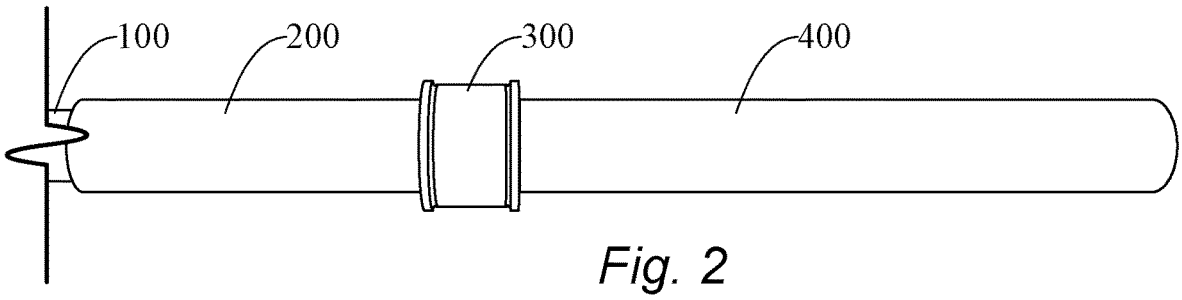
FIG. 2 is a detailed top plan view of the embodiment shown in FIG. 1, showing Detail A.

FIG. 2 is a detailed top plan view of the embodiment shown in FIG. 1, showing Detail A. Moving from the center of the flexible tube 100 to an end of the flexible tube 100, the next element would be the optional rack bumper 200. Generally speaking, the rack bumper 200 would have a cylindrical shape also having a hollow center for accepting the flexible tube 100. To assemble the two components together, the optional rack bumper 200 may slide over the flexible tube 100 and could be held in place either by an adhesive or epoxy, through an interference fit between the inner diameter of the rack bumper 200 and the outer diameter of the flexible tube 100, or by some combination of these. Generally speaking, the optional rack bumper 200 may be used to reduce the wear on the flexible tube 100 as the mildly kinetic barbell is placed/removed from various weight lifting apparatuses (bench rack, squat rack, storage rack, etc.). Further, it has been discovered that the rack bumper 200 can also help with the dissipation of energy within the mildly kinetic barbell. As noted however, the rack bumper 200 is not required for the invention.

Continuing to move to an end of the flexible tube 100 from the center, the next element in the assembly is a plate stopper 300. While this embodiment shows a separate rack bumper 200 and plate stopper 300, the two elements could also be combined into a single element. All that would be required for a plate stopper 300 is an element that has an outer diameter that is greater than the diameter of the end sleeve 400, so that plates of weight could not slide past the combination rack bumper 200/plate stopper 300, whether it is combined with the rack bumper 200 or whether a rack bumper 200 is a separate element or not used at all.

Finally, at the end of the flexible tube 100 is preferably an loading sleeve 400, which would also preferably have a hollow center and would preferably slide over the flexible tube 100. To assemble the two components together, the loading sleeve 400 may slide over the flexible tube 100 and could be held in place either by an adhesive or epoxy, through an interference fit between the inner diameter of the loading sleeve 400 and the outer diameter of the flexible tube 100, or by some combination of these.

Figure 3:
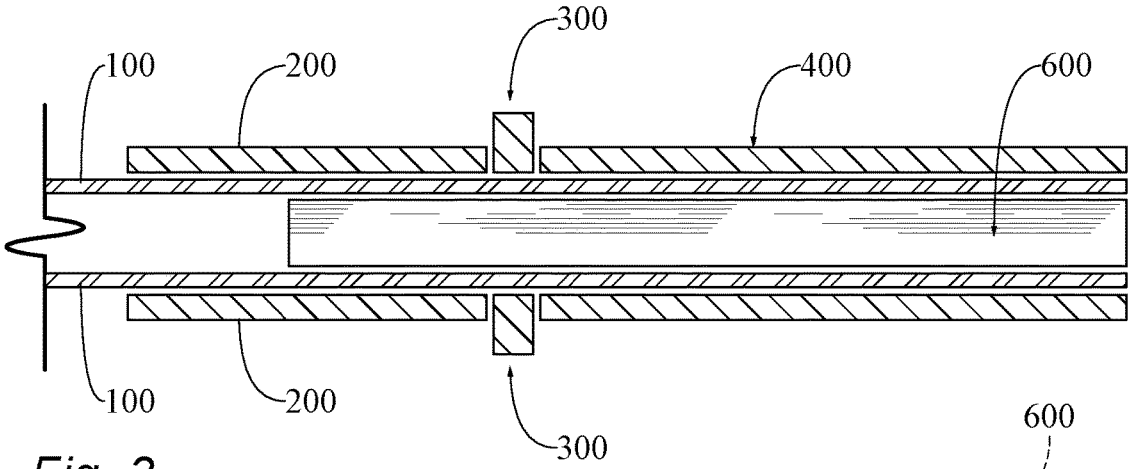
FIG. 3 is an exploded section view taken at Detail A and passing through the central axis of the embodiment shown in FIG. 1.

FIG. 3 is an exploded section view taken at Detail A and passing through the central axis of the embodiment shown in FIG. 1. Looking at the end of the mildly kinetic barbell, preferably the flexible tube 100, loading sleeve 400, and stiffening element 600 travel all the way to the end of the mildly kinetic barbell. In other words, the ends of the flexible tube 100, loading sleeve 400, and stiffening element 600 are preferably flush with one another at the end of the mildly kinetic barbell. Preferably, the stiffening element 600 begins at the end of the mildly kinetic barbell and travels past the plate stopper 300, although this is not required. The stiffening element 600 could stop at the plate stopper 300 or just short of the plate stopper 300.

For this embodiment, the opposing end of the barbell (i.e. the end at the top of the picture when looking at FIG. 1) is a mirror image of the features shown in Detail A. Also for this embodiment, the stiffening element 600 is preferably not found within the central portion of the flexible tube 100, which should preferably remain hollow. The stiffening element 600 should have a solid center, in other words would preferably not be hollow. The stiffening element 600 should have a bending strength that is less than that of the flexible tube 100, and it has been found that a bending strength between 8,000 and 20,000 psi works well, but is preferably between 10,000 and 16,000 psi.

It has been found that a wooden dowel works well for the stiffening element 600, but this is not required, as other materials such as plastic or composites could work as well, depending on the application. Specifically, a nylon, polyurethane, high-density polyethylene (HDPE), or similar plastic would be suitable as well. When using wood as the stiffening element 600, a North American hardwood of some type would preferably be used, but the precise type could vary depending on the application. Again, any material (whether wood, plastic, or a composite) could also be used as long as it had the necessary properties for bending strength, oscillation, and durability. The stiffening element 600 should have an outer diameter that is substantially the same size as the inner diameter of the flexible tube 100. The stiffening element 600 could be held in place with adhesive or epoxy, through an interference fit between the outer diameter of the stiffening element 600 and the inner diameter of the flexible tube 100, or by some combination of these.

In each embodiment shown herein, it is preferable that the stiffening element(s) 600 is rigidly fixed within the flexible tube 100 such that the two elements cannot move or rotate relative to one another. There should not be a substantial gap between the stiffening element(s) 600 and the flexible tube, instead, as indicated by some of the sample dimensions provided below, there should be virtually no gap, with even an interference being possible (depending on the tolerancing of each part).

Also, it should be noted that the particular section view shown in FIG. 3 is an exploded section view, such that space is indicated between the various layers, but this is not how the exemplary embodiments are actually formed in a true section view. As an example, while there is a gap indicated between the loading sleeve 400 and the flexible tube 100, this gap is only used to clearly illustrate the various layers, and no such gap would generally be present in the exemplary embodiments. The same would be true for the remaining gaps (i.e. between the stiffening element 600 and the flexible tube 100, plate stopper 300 and flexible tube 100, and the rack bumper 200 and the flexible tube 100). Of course, small gaps can be present, and would not necessarily effect the device, but many times these small gaps would preferably be filled with an adhesive or epoxy when assembling the exemplary embodiments. The gaps here have been exaggerated in size in order to clarify the various layers.

The plate stopper 300 is preferably adjacent to the loading sleeve 400, and would also not have a substantial gap as shown in this figure. Similarly, the rack bumper 200 is preferably adjacent to the plate stopper 300, and would again not have a substantial gap as shown in this figure.

Figure 4:
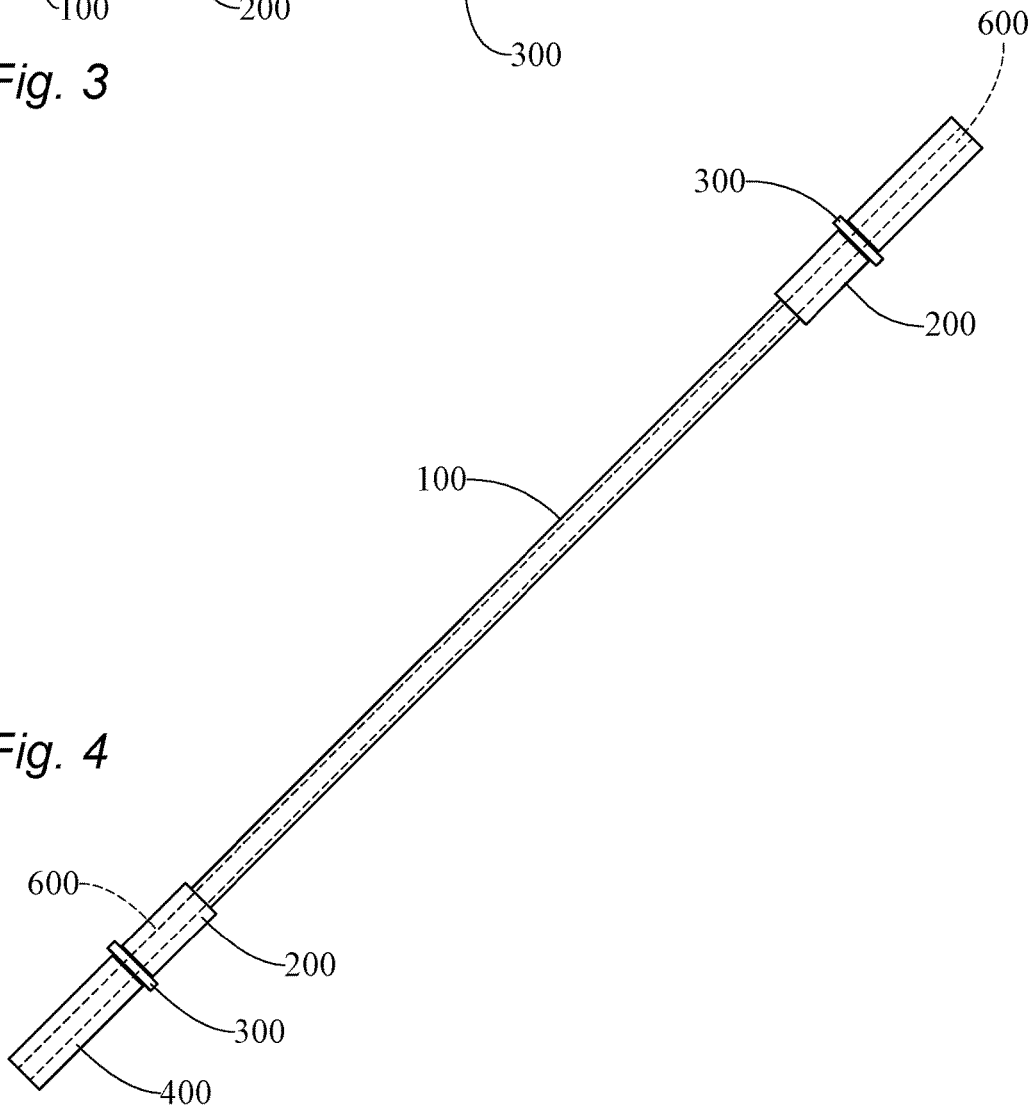
FIG. 4 is a top plan view of another exemplary embodiment of the mildly kinetic barbell, indicating a full-length stiffening element with hidden lines.

FIG. 4 is a top plan view of another exemplary embodiment of the mildly kinetic barbell, indicating a full-length stiffening element 600 with hidden lines. In this embodiment, rather than placing the stiffening element 600 only on the ends of the bar, the stiffening element 600 travels along substantially the entire length of the bar. The stiffening element 600 may extend all the way to the ends of the bar in order to be flush with the flexible tube 100, but may be slightly shorter or slightly longer than the flexible tube in some embodiments. Preferably, the stiffening element 600 would preferably extend along most of the length of the bar. This embodiment provides a slightly stiffer design than the embodiments shown above.

Figure 5:
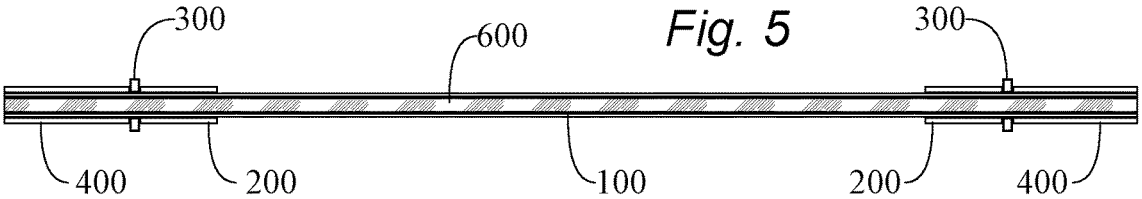
FIG. 5 is a simplified section view of the embodiment from FIG. 4, with a section line passing through the central axis.

FIG. 5 is a simplified section view of the embodiment from FIG. 4, with a section line passing through the central axis. It should be noted that some layers, such as those for 200, 300, and 400, are so thin that they were not given section shading for clarity.

FIG. 6 is a chart showing some example dimensions for various embodiments of the mildly kinetic barbell. Initially, it should be noted that the dimensions here are only shown for an example of some dimensions that have been found to be effective, but the invention is not limited to these dimensions and one of ordinary skill in the art could accomplish the benefits of the invention while modifying these dimensions to suit the particular application, specifically if designing a smaller-sized or larger-sized barbell for specific applications.

Figure 7:
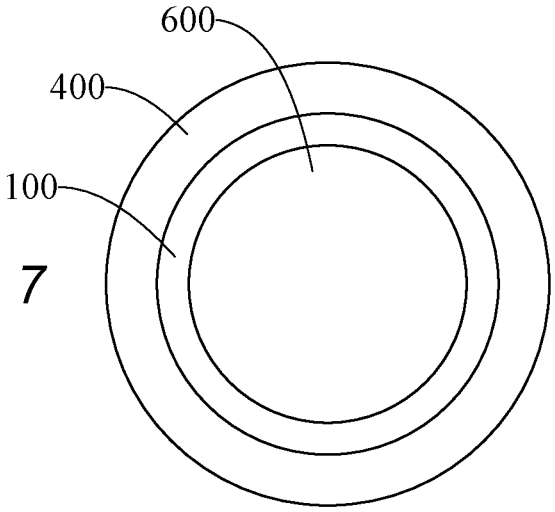
FIG. 7 is a side plan view of an exemplary embodiment of the mildly kinetic barbell.

FIG. 7 is a side plan view of an exemplary embodiment of the mildly kinetic barbell. Here, the various layers at the end of the mildly kinetic barbell are shown, where the ends of the flexible tube 100, loading sleeve 400, and stiffening element 600 are preferably flush with one another at the end of the mildly kinetic barbell. A layer of adhesive or epoxy may be found between each element, if necessary.

Figure 8:
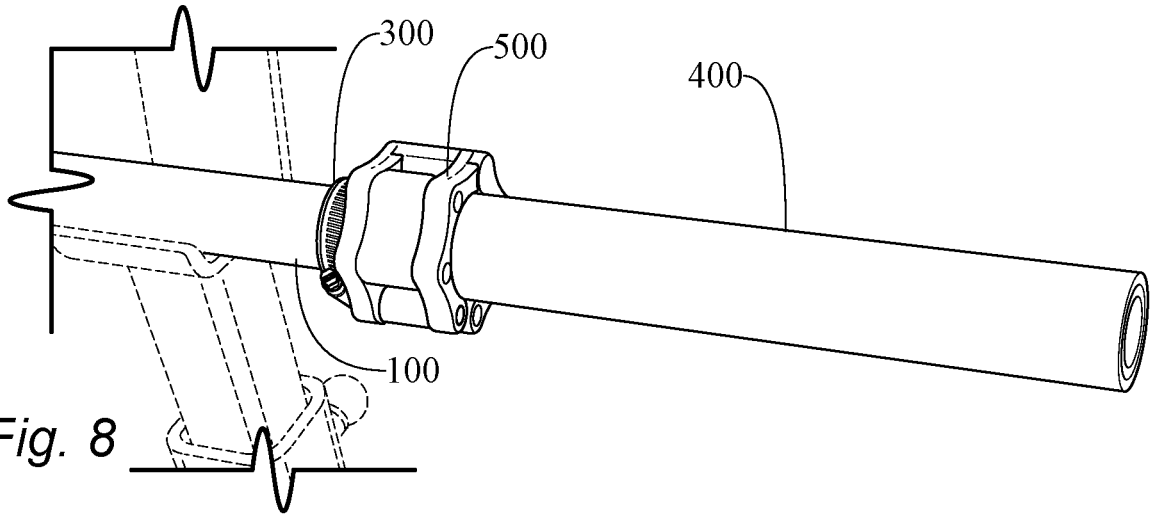
FIG. 8 is a perspective view of another embodiment of the mildly kinetic barbell.

FIG. 8 is a perspective view of another embodiment of the mildly kinetic barbell. This embodiment does not use the rack bumper 200 that was shown above, since this element is optional. Instead, only a plate stopper 300 is used, and the mildly kinetic barbell would be sit atop the flexible tube 100 when placed on a rack (as shown). A removable clamp 500 may also be used to hold plates of weight in between the plate stopper 300 and the clamp 500, so that plates of weight cannot slide off the end of the mildly kinetic barbell during use. The loading sleeve 400 is preferably still used in this embodiment.

Figure 9:
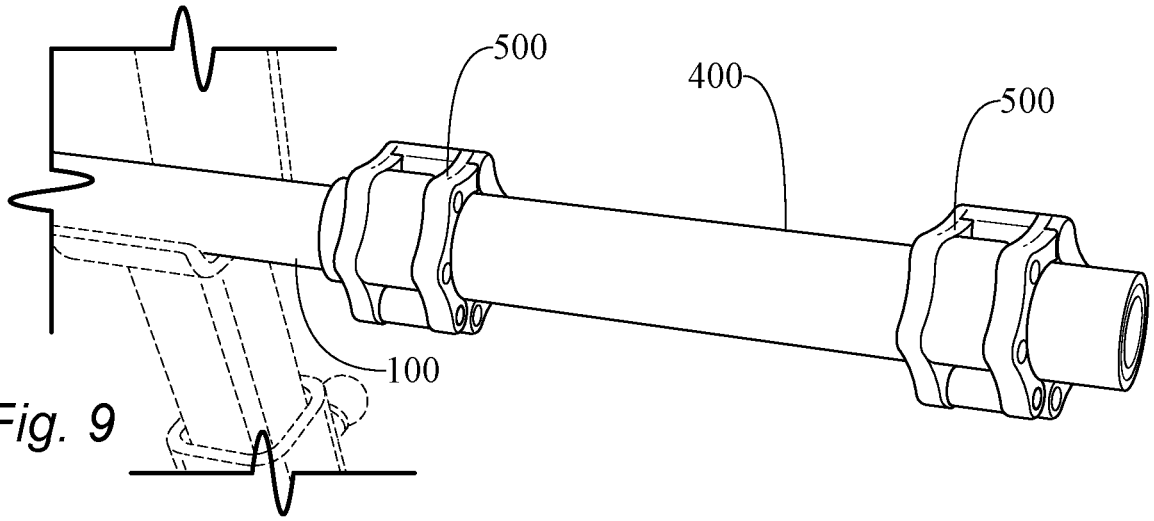
FIG. 9 is a perspective view of another embodiment of the mildly kinetic barbell.

FIG. 9 is a perspective view of another embodiment of the mildly kinetic barbell. This embodiment does not use a rack bumper 200 or a plate stopper 300, and simply uses a pair of clamps 500 to 'sandwich' the plates securely on the loading sleeve 400. The loading sleeve 400 is thus preferably still used in this embodiment as well.

Figure 10:
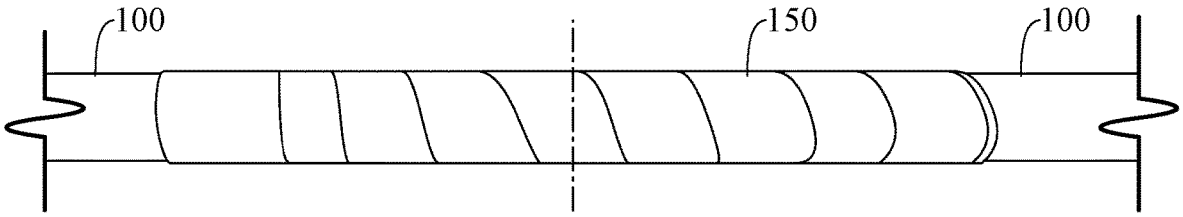
FIG. 10 is a partial top perspective view of the central portion of another embodiment of the mildly kinetic barbell, showing an optional knurl.

FIG. 10 is a partial top perspective view of the central portion of another embodiment of the mildly kinetic barbell, showing an optional knurl 150. Here, an optional knurl 150 has been positioned on the central portion of the bar, preferably centered on the mid-point of the bar (as shown) and wrapped around the flexible tube 100. Preferably, the knurl 150 is produced by wrapping, with a 15%-80% overlap, fiber tape around a central portion of the flexible tube 100, and most preferably would be a carbon fiber tape with a 40%-60% overlap, ideally held around 50%. The knurl 150 is preferably between 10 inches and 20 inches long, and is most preferably approximately 15 inches long and centered on the mid-point of the bar.

Figure 11:
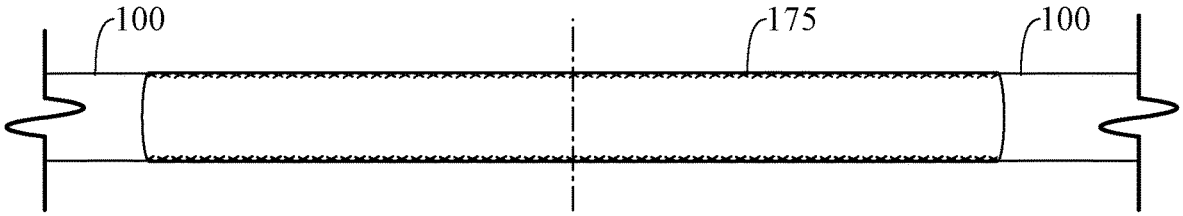
FIG. 11 is a partial top perspective view of the central portion of another embodiment of the mildly kinetic barbell, showing an optional stiffening tube.

FIG. 11 is a partial top perspective view of the central portion of another embodiment of the mildly kinetic barbell, showing an optional stiffening tube 175. In this embodiment, a stiffening tube 175 is slipped over the flexible tube 100 and positioned on the central portion of the bar, preferably centered on the mid-point of the bar. The stiffening tube 175 should have a bending strength that is higher than the flexible tube 100. Preferably, the stiffening tube 175 is comprised of carbon fiber and would be fixed in place on the flexible tube 100 with adhesive or epoxy. An example of acceptable dimensions for the stiffening tube 175 have been found to be a length of 15 inches, outside diameter of 1.75 inches, and an inside diameter of 1.50 inches.

It has been discovered that the optional knurl 150 and stiffening tube 175 can provide a number of different benefits. Primarily, the knurl 150 and stiffening tube 175 provide an additional layer of strength, but only to the central portion of the mildly kinetic barbell, allowing very heavy loads of plates to be applied while still having enough strength, mild oscillation, and instability in the bar to activate the stabilizing muscles and remove the extreme stresses to the joints. In addition, the knurl 150 provides a textured surface for griping or stabilizing the barbell, especially during squats and lunges.

The optional rack bumper 200, optional plate stopper 300, and loading sleeve 400 can be made of several different types of materials, but are preferably comprised of a slightly compressible material, including many types of elastomers, but preferably a rubber. It is preferable that these components are made of a material having a durometer between 70 and 100, more preferably between 80 and 90. It is also preferable that these components have a percent elongation between 250 and 450 and more preferably between 300 and 400. It is also preferable that these components are made of a material having a specific gravity between 1.18 and 1.24. However, it should be noted that the optional rack bumper 200, plate stopper 300, and loading sleeve 400 may be made of the same material, or could each be made of different materials. In an exemplary embodiment, the rack bumper 200, plate stopper 300, and loading sleeve 400 would each be comprised of a rubber material.

The terms "adhesive" and "epoxy" have been used interchangeably herein and it should be recognized that there are many types of adhesives and epoxies that could work with the embodiments herein. Thus, these terms are used interchangeably herein and should be generally recognized as equivalents for the purposes of a substance that binds two elements together and resists their separation.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

I claim:

1. A mildly kinetic barbell comprising a flexible tube having a hollow center with a cross-sectional area and a central axis extending through a length of the flexible tube; a rigid bar within the hollow center of the flexible tube and having a length that is the same length as the flexible tube such that a first end of the flexible tube is aligned with a first end of the rigid bar, and an opposing second end of the flexible tube is aligned with an opposing second end of the rigid bar; a first plate stopper having an inner circumference wherein the inner circumference of the first plate stopper is attached to an outer circumference of the flexible tube near the first end of the flexible tube; and a second plate stopper having an inner circumference wherein the inner circumference of the second plate stopper is attached to the outer circumference of the flexible tube near the second end of the flexible tube.

2. The mildly kinetic barbell of claim 1 wherein the rigid bar traverses the entire length of the flexible tube.

3. The mildly kinetic barbell of claim 1 further comprising a first loading sleeve having an inner circumference surrounding the outer circumference of the flexible tube and travelling continuously from the first plate stopper to the first end of the flexible tube; and a second loading sleeve having an inner circumference surrounding the outer circumference of the flexible tube and travelling continuously from the second plate stopper to the second end of the flexible tube.

4. The mildly kinetic barbell of claim 1 further comprising a first rack bumper having an inner circumference surrounding the outer circumference of the flexible tube and positioned adjacent to the first plate stopper; and a second rack bumper having an inner circumference surrounding the outer circumference the flexible tube and positioned adjacent to the second plate stopper.

5. The mildly kinetic barbell of claim 1 wherein the rigid bar shares the same central axis as the flexible tube.

6. A mildly kinetic barbell comprising a flexible tube having a first end, an opposing second end, and a mid-point;

a rigid bar within a hollow center of the flexible tube so that the rigid bar cannot move relative to the flexible tube, the rigid bar having a length that is the same length as the flexible tube such that the first end of the flexible tube is aligned with a first end of the rigid bar, and the opposing second end of the flexible tube is aligned with an opposing second end of the rigid bar; a first loading sleeve having an inner circumference surrounding an outer circumference of the flexible tube and travelling from the first end of the flexible tube towards the mid-point of the flexible tube; and a second loading sleeve having an inner circumference surrounding an outer circumference of the flexible tube and travelling from the second end of the flexible tube towards the mid-point of the flexible tube.

7. The mildly kinetic barbell of claim 6 wherein the rigid bar traverses an entire length of the flexible tube.

8. The mildly kinetic barbell of claim 6 wherein an interior diameter of the flexible tube is substantially equal to an outer diameter of the rigid bar.

9. The mildly kinetic barbell of claim 6 wherein a cross-sectional area of the rigid bar, taken perpendicular to a central axis of the rigid bar, is substantially equal to an interior area of the flexible tube, also taken perpendicular to a central axis of the flexible tube.

10. The mildly kinetic barbell of claim 6 wherein the first and second loading sleeves are comprised of a material having a durometer between 70 and 100 and a percent elongation between 250 and 450.

11. The mildly kinetic barbell of claim 6 wherein the rigid bar is comprised of a wooden dowel and the first and second loading sleeves are comprised of a rubber.

12. The mildly kinetic barbell of claim 6 further comprising a first rack bumper having an inner circumference surrounding the outer circumference of the flexible tube and positioned adjacent to the first loading sleeve; and a second rack bumper having an inner circumference surrounding the outer circumference of the flexible tube and positioned adjacent to the second loading sleeve.

13. A mildly kinetic barbell comprising a flexible tube having an interior cavity, a first end, an opposing second end, and a mid-point;

a rigid bar fitted within the interior cavity of the flexible tube and extended substantially an entire length of the flexible tube, a length of the rigid bar is the same length as the flexible tube such that the first end of the flexible tube is aligned with a first end of the rigid bar, and the opposing second end of the flexible tube is aligned with an opposing second end of the rigid bar; a first rubber loading sleeve having an inner circumference surrounding an outer circumference of the flexible tube and travelling from the first end of the flexible tube towards the mid-point of the flexible tube; a second rubber loading sleeve having an inner circumference surrounding the outer circumference of the flexible tube and travelling from the second end of the flexible tube towards the mid-point of the flexible tube; a first plate stopper having an inner circumference attached to the outer circumference of the flexible tube and positioned adjacent to the first loading sleeve; and a second plate stopper having an inner circumference attached to the outer circumference of the flexible tube and positioned adjacent to the second loading sleeve.

14. The mildly kinetic barbell of claim 13 further comprising a first rack bumper having an inner circumference surrounding the outer circumference of the flexible tube and positioned adjacent to the first plate stopper; and a second rack bumper having an inner circumference surrounding the outer circumference of the flexible tube and positioned adjacent to the second plate stopper.

15. The mildly kinetic barbell of claim 13 further comprising a first end of the rigid bar which is flush with the first end of the flexible tube; and a second end of the rigid bar which is flush with the second end of the flexible tube.

16. The mildly kinetic barbell of claim 13 wherein the rigid bar is held within the flexible tube with an interference fit.

17. The mildly kinetic barbell of claim 13 wherein the flexible tube is comprised of a composite fiber tube.

18. The mildly kinetic barbell of claim 13 wherein the rigid bar is a wooden dowel.

19. The mildly kinetic barbell of claim 13 further comprising a knurl that is positioned on a central portion of the flexible tube.

* * * * *